United States Patent [19]

Sissin et al.

[11] 4,424,134

[45] Jan. 3, 1984

[54] AQUEOUS FABRIC SOFTENING COMPOSITIONS

[75] Inventors: Margaret P. Sissin, Dayton; Richard D. Walker, Wyoming, both of Ohio

[73] Assignee: The Procter & Gamble Company, Cincinnati, Ohio

[21] Appl. No.: 504,649

[22] Filed: Jun. 15, 1983

[51] Int. Cl.[3] ..... D06M 13/46; D06M 13/28

[52] U.S. Cl. ..... 252/8.8; 252/8.6

[58] Field of Search ..... 252/8.8

[56] References Cited

U.S. PATENT DOCUMENTS 4,265,899 5/1981 Lewis et al. ..... 424/270

FOREIGN PATENT DOCUMENTS 53-115000 10/1978 Japan ..... 252/8.8

OTHER PUBLICATIONS

"Kathon® CG Cosmetic and Toiletry Preservative" Brochure, 1982, Rohm and Haas Company.

*Primary Examiner*—Maria Parrish Tungol

*Attorney, Agent, or Firm*—Richard C. Witte; Ronald L. Hemingway

[57] ABSTRACT

Aqueous fabric softening compositions containing cationic softeners, amines, and certain 3-isothiazolones as antimicrobial agents are formulated at a pH below about 6 to improve the stability of the antimicrobial agent in the presence of the amine.

10 Claims, No Drawings

AQUEOUS FABRIC SOFTENING COMPOSITIONS

FIELD OF THE INVENTION

This invention relates to aqueous cationic fabric softening compositions which contain amines and which contain certain 3-isothiazolones as antimicrobial agents.

BACKGROUND

Aqueous fabric softening compositions containing typical cationic softeners such as ditallowdimethyl ammonium chloride or 1-methyl-1-tallowamidoethyl-2-tallow imidazolinium methylsulfate are subject to microbial contamination during production and packaging, and/or after the package containing the product is opened by the consumer. The cationic softeners provide a suitable nutrient medium for the microbes, with the result that malodors develop.

U.S. Pat. No. 4,265,899, Lewis et al., issued May 5, 1981, describes certain 3-isothiazolones which are useful antimicrobial agents. A representative member of the class of compounds encompassed by that patent is 5-chloro-2-methyl-3-isothiazolone and is sold under the name KATHON ® CG by Rohm and Haas Company.

The 3-isothiazolones are effective biocides for use in cationic fabric softening compositions. However, it has been found that if the compositions contain amines, the antimicrobial activity of the 3-isothiazolone is rapidly diminished during storage of the composition. Since cationic softening agents are prepared from amines and often contain some amine as a contaminant, and since it is sometimes desirable to add certain amines to fabric softening compositions to take advantage of their emulsifying and/or fabric conditioning properties, the incompatibility of the 3-isothiazolones with fabric softener compositions containing amines is a serious impediment to the use of these antimicrobial agents in fabric softening compositions.

The object of the present invention is to formulate cationic fabric softener compositions which contain amines and which can utilize 3-isothiazolones as antimicrobial agents.

SUMMARY OF THE INVENTION

The invention relates to aqueous compositions containing a cationic fabric softener, amines and certain 3-isothiazolone antimicrobial agents, wherein the composition is formulated to have a pH which is lower than about 6, so as to retard inactivation of the 3-isothiazolone by the amine.

DESCRIPTION OF THE PREFERRED EMBODIMENTS

In accordance with the present invention it has been found that the activity of 3-isothiazolone antimicrobial agents can be better preserved in aqueous cationic fabric softener compositions containing amines if the pH of the composition is kept below about 6, preferably below about 5.

The present invention is directed to an aqueous fabric softener composition comprising water, cationic softener, amines and a 3-isothiazolone compound having the formula:

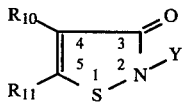

wherein

Y is an unsubstituted or substituted alkyl, alkenyl, or alkynyl group of 1 to 18 carbon atoms, an unsubstituted or substituted cycloalkyl group having a 3 to 6 carbon ring and up to 12 carbon atoms, an unsubstituted or substituted aralkyl group of up to 10 carbon atoms, or an unsubstituted or substituted aryl group of up to 10 carbon atoms, $R_{10}$ is hydrogen, halogen, or a ($C_1$–$C_4$) alkyl group, $R_{11}$ is hydrogen, halogen, or a ($C_1$–$C_4$) alkyl group, and the salts of said 3-isothiazolone compounds; the said composition having a pH which is below about 6.

Cationic Softeners

The cationic softeners used in the present compositions can be any of those substantially water-insoluble cationic active materials generally recognized in the art for their fabric softening properties. Typical examples are:

A. Mono nitrogen quaternary ammonium cationic salts having the structure:

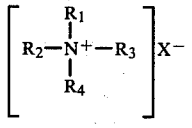

wherein $R_1$ is selected from $C_1$ to $C_{20}$ alkyl and alkenyl groups, and $R_2$ is selected from the group consisting of $C_{14}$ to $C_{20}$ alkyl and alkenyl groups and $R_3$ and $R_4$ are the same or different from each other and are selected from the group consisting of $C_1$ to $C_3$ alkyls, or $-(C_nH_{2n}O)_xH$ wherein n is 2 or 3, x is from 1 to about 3, and wherein $X^-$ is halide, $HSO_4^-$, nitrate, methylsulfate or ethylsulfate. It is preferred that $X^-$ be halide, and the preferred halides are chloride and bromide. Exemplary compounds of this class are: stearyltrimethyl ammonium chloride, myristyltriethyl ammonium bromide, dimyristyldimethyl ammonium chloride, dipalmityldiethyl ammonium bromide, distearyldimethyl ammonium chloride, distearyldimethyl ammonium bromide, distearyldiisopropyl ammonium bromide, diarachidyldimethyl ammonium chloride, distearyl-2-hydroxypropylmethyl ammonium chloride, oleylstearyldimethyl ammonium ethylsulfate and distearyl-2-hydroxyethylmethyl ammonium methylsulfate. Preferably the $R_1$ and $R_2$ groups are derived from tallow and the $R_3$ and $R_4$ groups are methyl. The tallow can be hydrogenated or unhydrogenated. Hydrogenated (i.e., saturated) tallow is preferred, and halides are the preferred anions. Accordingly, preferred mono nitrogen quaternary ammonium salt softener compounds herein are dihydrogenatedtallow dimethyl ammonium chloride and dihydrogenatedtallow dimethyl ammonium bromide.

B. Imidazolinium salts of the formula:

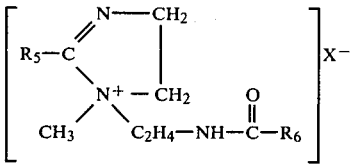

wherein $R_5$ and $R_6$ are the same or different from each other and are selected from the group consisting of $C_{14}$ to $C_{20}$ alkyl and alkenyl groups, wherein $X^-$ is as defined above.

Exemplary compounds of this type are; 1-methyl-1-tallowamidoethyl-2-tallowimidazolinium methylsulfate, 1-methyl-1-oleylamidoethyl-2-oleylimidazolinium chloride, 1-methyl-1-palmitoleylamidoethyl-2-palmitoleylimidazolinium ethylsulfate, 1-methyl-1-soyaamidoethyl-2-soyaimidazolinium methylsulfate and 1-methyl-1-hydrogenatedtallowamidoethyl-2-hydrogenatedtallowimidazolinium methylsulfate.

C. Di(2-amidoethyl)methyl quaternary ammonium salts having the structure:

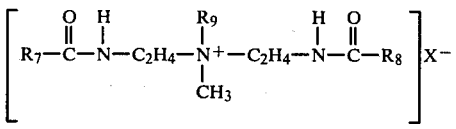

wherein $R_7$ and $R_8$ are the same or different from each other and are selected from the group consisting of $C_{14}$ to $C_{20}$ alkyl and alkenyl groups, wherein $R_9$ is selected from H, methyl, ethyl and $-(C_nH_{2n}O)_xH$ wherein n is 2 or 3 and x is from 1 to about 5 (preferably 3), and wherein $X^-$ is as defined above. Preferably $R_7$ and $R_8$ are alkyl and $R_9$ is $-(C_nH_{2n}O)_xH$. This class of compounds is disclosed in U.S. Pat. No. 4,134,840, Minegishi et al., issued Jan. 16, 1979, incorporated herein by reference.

Exemplary compounds are di(di-hydrogenatedtallowamidoethyl) ethoxylated (2 ethoxy groups) methyl ammonium methylsulfate, di(2-hydrogenatedtallowamidoethyl) dimethyl ammonium ethylsulfate, di(2-palmitylamidoethyl)-2-hydroxyethyl ammonium chloride, di(2-oleylamidoethyl) propoxylated (3 propoxy groups) methyl ammonium bromide, di(2-palmitoleylamidoethyl) dimethyl ammonium ethylsulfate and di(2-stearylamidoethyl) propoxylated (2 propoxy groups) methyl ammonium methylsulfate.

The cationic softener compounds are present in the compositions of the invention at levels of from about 1% to about 50%, preferably from about 3% to about 25%. The softeners can be used singly or in mixtures.

All percentages and ratios herein are "by weight" unless stated otherwise.

3-Isothiazolone Compounds

The 3-isothiazolone compounds, used as biocidal preservatives in the compositions of the invention have the formula:

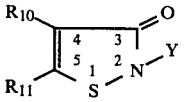

wherein

Y is an unsubstituted or substituted alkyl, alkenyl, or alkynyl group of 1 to 18 carbon atoms, an unsubstituted or substituted cycloalkyl group having a 3 to 6 carbon ring and up to 12 carbon atoms, an unsubstituted or substituted aralkyl group of up to 10 carbon atoms, or an unsubstituted or substituted aryl group of up to 10 carbon atoms, $R_{10}$ is hydrogen, halogen, or a $(C_1-C_4)$ alkyl group, and $R_{11}$ is hydrogen, halogen, or a $(C_1-C_4)$ alkyl group.

Preferably, when Y is methyl or ethyl, $R_{10}$ and $R_{11}$ should not both be hydrogen.

Salts of these compounds formed by reacting the compound with acids such as hydrochloric, nitric, sulfuric, etc., are also suitable.

This class of compounds is disclosed in U.S. Pat. No. 4,265,899, Lewis et al., issued May 5, 1981, and incorporated by reference herein. Examples of the said compounds are: 2-n-butyl-3-isothiazolone, 2-benzyl-3-isothiazolone, 2-phenyl-3-isothiazolone, 2-methyl-4,5-dichloroisothiazolone, and 5-chloro-2-methyl-3-isothiazolone. A preferred compound is 5-chloro-2-methyl-3-isothiazolone, which is sold under the name KATHON® CG by Rohm and Haas Company.

The 3-isothiazolones are used in the compositions herein at levels sufficient to control microbial growth in the compositions. The amount will usually be within the range of from about 0.1 ppm to about 20 ppm, preferably from about 1 ppm to about 10 ppm.

Amines

The amines in the compositions herein are present either as contaminants which are sometimes present in the cationic softeners which are used, or are purposely added to the compositions to impart some desired property, e.g., for improved emulsification of the cationic softeners, for freeze-thaw recovery (i.e., recovery of the compositions to a homogeneous condition after being frozen), for viscosity control, or as supplementary softeners.

Amine levels of about 0.05% or higher in the compositions are sufficient to significantly reduce the effectiveness of the 3-isothiazolone as a biocidal preservative when the product is stored for a few days or more. Generally the amount of amine present in the compositions herein will be from about 0.05% to about 5%, more typically from about 0.1% to about 2%.

Typical amine contaminants in cationic fabric softener compositions are dihydrogenatedtallow methyl amine, 1-tallowamidoethyl-2-tallowimidazoline, and di(2-hydrogenatedtallowamidoethyl)alkyl ethoxylated amine.

Useful amines for freeze-thaw recovery, emulsification, and viscosity control are compounds of the formula:

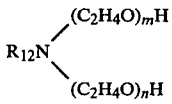

wherein $R_{12}$ is an alkyl or alkenyl group of from about 14 to about 20 carbon atoms and m+n is from about 2 to about 30. A typical commercial material of this class is sold under the name Varonic T-220D by Sherex Chemical Company.

Diamines are also useful emulsifying and freeze-thaw recovery agents in the compositions herein. (See U.S. Pat. No. 4,045,361, Watt et al., issued Aug. 30, 1977, and EPO Application 18039, Clint et al., published Oct. 29, 1980, both incorporated by reference herein.) A typical exemplary diamine is N-talloyl-N,N',N'-tris(2-hydroxyethyl)-1,3-propane-diamine.

Typical monoamines which can be used as supplementary softeners include stearyldimethyl amine, dihydrogenatedtallowmethyl amine and hydrogenatedtallowdimethyl amine.

While the invention herein is not to be limited by any particular theory or mechanism of operation, it is believed that the amines, in their "free amine" form, chemically interact with the 3-isothiazolone antibacterial agents and that conversion of the amines to their protonated form by maintaining an acid pH retards this interaction.

The term "amine" as used herein does not include the 3-isothiazolone compounds.

pH Control

It has been found, in accordance with the present invention if the pH of the fabric softener composition is maintained at a level below about 6, deterioration of the effectiveness of the 3-isothiazolone as a biocidal preservative in the composition is retarded. This is done by adjusting the composition to the desired pH at the time it is made. Any acid may be used for this purpose. Typically acids such as citric, hydrochloric, phosphoric and sulfuric are used because of their low cost and ready availability. The amount of acid used will be that which is sufficient to provide the desired pH. Preferably, the pH will be below 5, and more preferably from about 3 to about 5. Generally, pH's below 3 will provide further improvements in 3-isothiazolone stability due to more complete conversion of the amine to the protonated form, however, it is generally desirable in fabric softeners to keep the pH above about 3, so as not to adversely affect the perfumes which are usually used in the compositions, and/or adversely affect the physical stability of the compositions. A pH which is more acid than desired can be adjusted upward with a base such as sodium hydroxide or sodium carbonate.

Optional Ingredients

Materials which are typically used in fabric softener compositions can be optionally used in the compositions of the present invention. These include lower alcohols (e.g., ethanol, isopropanol, etc.) at 0 to 5%, perfumes at 0 to 1.0%, dyes at 0 to 0.1%, ionizable salts for viscosity control at from about 0 to about 0.5%, nonionic fabric softeners (e.g., long-chain hydrocarbons and fatty glycerides) at 0 to about 10%, and polyethylene glycols at levels of 0% to 2%.

The invention will be further illustrated by the following examples.

EXAMPLE 1

This example illustrates the preparation of a 200 lb. batch of a composition of the present invention containing 1% Varonic T220D, a monotallow di(polyethoxy)amine, containing a total of about 20 ethoxy groups.

Materials for Use in the Composition

[1]23 lbs. 87% active dihydrogenatedtallowdimethylammonium chloride (DTDMAC)

[2]11.8 lbs. 85% active di(2-hydrogenatedtallowamidoethyl) ethoxylated methyl ammonium methylsufate (Varisoft 110)

[3]11.2 lbs. 90% active 1-methyl-1-unsaturatedtallowamidoethyl-2-unsaturatedtallowimidazolinium methylsulfate (Varisoft 475, I.V. 42)

0.6 lbs. 1.35% solution of Polar Brilliant Blue dye in water 760 ml 25% w/w $CaCl_2$ in water 1.5 lbs. perfume 146 lbs. deionized water 61 grams of Kathon CG® (1.5% active 5-chloro-2-methyl-3-isothiazolone).

2.0 lbs. 50% w/v PEG 8000 in water 2.0 lbs. Varonic T220D

[1]Contains ~8% ethanol.

[2]Contains ~12% isopropanol.

[3]Contains ~10% isopropanol.

Equipment 20 gallon capacity steam-jacketed pre-mix tank 60 gallon capacity main-mix tank equipped with vertically mounted, variable speed (50–500 rpm) mixer with impeller

Procedure

The premix tank was charged with the molten softener actives in the sequence DTDMAC, Varisoft 110, Varisoft 475. The resulting mixture was heated with stirring to 172° F., at which time the dye solution was added.

The main-mix tank was charged with 17.5 gal. (146 lbs.) of deionized water and 2.0 lbs. Varonic T220D, and the mixture was heated to 110° F. The agitator was set at 150 rpm and the contents of the pre-mix tank (at 172° F.) were pumped into the main-mix tank over a period of 5 minutes. During this 5 minute period the agitator speed was gradually increased to 250–300 rpm as the main-mix thickened. Also, beginning at the point where about 90% of the premix had been added, and ending after final component (Kathon CG®) was added to the bath, the $CaCl_2$ solution was added in portions so as to maintain a stirrable, flowable mixture throughout production of the batch, and gradually to trim viscosity. As the viscosity decreased the agitator speed was gradually reduced back to 150 rpm. The perfume was added 20 minutes after the start of addition of the softener pre-mix to the main-mix tank. The PEG 8000 solution (50%) was added next followed immediately by the Kathon CG solution (1.5%). The viscosity of the warm product was 67 cps at the end of making. Upon cooling the viscosity was about 130 cps.

The composition above had the following approximate formula:

| Component | Wt. % |
|---|---|
| Dihydrogenatedtallowdimethyl ammonium chloride | 10 |
| Di(2-hydrogenatedtallowamidoethyl) ethoxylated methyl ammonium methylsulfate | 5 |
| 1-methyl-1-tallowamidoethyl-2-tallowimidazolinium methylsulfate (I.V. 42) | 5 |
| Polar Brilliant Blue dye | 40 ppm |
| Calcium chloride | 0.25 |
| Perfume | 0.75 |
| PEG 8000 | 0.50 |
| Kathon CG | 0.001 |

-continued

| Component | Wt. % |
|---|---|
| Varonic T220D | 1.0 |
| Ethanol | 0.92 |
| Isopropanol | 1.36 |
| Deionized water | to 100 |

The Iodine Value of the total cationic active system was about 10.5.

This composition was then put into 1 gallon containers while still warm and the pH was adjusted by adding either a 20% NaOH solution or a 96.5% $H_2SO_4$ solution. The table below summarizes the amount used.

TABLE 1

| Composition | I | II | III | IV |
|---|---|---|---|---|
| 50% NaOH (drops) | 77 | — | — | — |
| 96.5% $H_2SO_4$ (drops) | — | — | 30 | 53 |
| pH | 6.45 | 6.05 | 5.5 | 5.0 |

Samples of these compositions were stored at 70° F. and 100° F. for 5 weeks and then analyzed for Kathon CG. The concentration of Kathon CG was then determined analytically by liquid chromatography. The results are listed in the following table.

TABLE 2

| | Kathon Stability | | | |
|---|---|---|---|---|
| Composition | I | II | III | IV |
| pH | 6.45 | 6.05 | 5.5 | 5.0 |
| | Kathon (ppm) | | | |
| Initial* | 13.5 | 13.5 | 13.5 | 13.5 |
| 5 weeks at 70° F. | 2.4 | 4.7 | 7.9 | 10.0 |
| 5 weeks at 100° F. | 0.9 | 1.2 | 2.5 | 6.3 |

*Initial value is approximated from analytical data.

What is claimed is:

1. An aqueous fabric softener composition comprising:

(a) water;

(b) at least 1% of one or more cationic fabric softeners;

(c) at least 0.05% of one or more amines; and (d) a 3-isothiazolone compound having the formula:

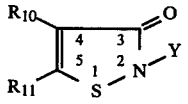

wherein

Y is selected from the group consisting of unsubstituted and substituted alkyl, alkenyl, and alkynyl groups of 1 to 18 carbon atoms, unsubstituted and substituted cycloalkyl groups having a 3 to 6 carbon ring and up to 12 carbon atoms, unsubstituted and substituted aralkyl groups of up to 10 carbon atoms, and unsubstituted and substituted aryl groups of up to 10 carbon atoms, $R_{10}$ is selected from the group consisting of hydrogen, halogen, and ($C_1$–$C_4$) alkyl groups, $R_{11}$ is selected from the group consisting of hydrogen, halogen, and ($C_1$–$C_4$) alkyl groups, and the salts of said 3-isothiazolone compounds;

wherein the said composition has a pH below about 6.

2. The composition of claim 1 wherein the amount of 3-isothiazolone compound is from about 0.1 to about 20 ppm.

3. The composition of claim 2 wherein the amount of cationic fabric softener is from about 1% to about 50%, and the amount of amine is from about 0.5% to about 2%.

4. The composition of claim 3 wherein the pH of the composition is from about 3 to about 6.

5. The composition of claim 4 wherein the fabric softener is selected from the group consisting of:

A. Mono nitrogen quaternary ammonium cationic salts having the structure:

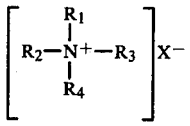

wherein $R_1$ is selected from the group consisting of $C_1$ to $C_{20}$ alkyl and alkenyl groups, $R_2$ is selected from the group consisting of $C_{14}$ to $C_{20}$ alkyl and alkenyl groups, and $R_3$ and $R_4$ are the same or different from each other and are selected from the group consisting of $C_1$ to $C_3$ alkyls, and $-(C_nH_{2n}O)_xH$ wherein n is 2 or 3, x is from 1 to about 3, and wherein $X^-$ is halide, $HSO_4^-$, nitrate, methylsulfate and ethylsulfate, B. Imidazolinium salts of the formula:

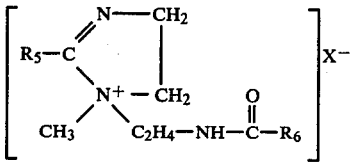

wherein $R_5$ and $R_6$ are the same or different from each other and are selected from the group consisting of $C_{14}$ to $C_{20}$ alkyl and alkenyl groups, and wherein $X^-$ is selected from the group consisting of halide, $HSO_4^-$, nitrate, methylsulfate or ethylsulfate, C. Di(2-amidoethyl)methyl quaternary ammonium salts having the structure:

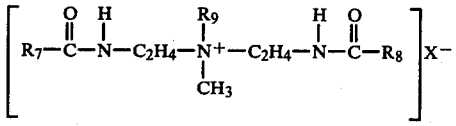

wherein $R_7$ and $R_8$ are the same or different from each other and are selected from the group consisting of $C_{14}$ to $C_{20}$ alkyl and alkenyl groups, wherein $R_9$ is selected from H, methyl, ethyl and $-(C_nH_{2n}O)_xH$ wherein n is 2 or 3 and x is from 1 to about 5, and wherein $X^-$ is selected from the group consisting of halide, $HSO_4^-$, nitrate, methylsulfate and ethylsulfate, and D. Mixtures thereof.

6. The composition of claim 5 wherein the amount of 3-isothiazolone compound is from about 1 ppm to about 10 ppm.

7. The composition of claim 6 wherein the amine is selected from the group consisting of 1-tallowamidoethyl-2-tallowimidazoline, dihydrogenated tallow methyl amine, di(2-hydrogenatedtallow) alkyl ethoxylated amine, and ethoxylated amines of the formula:

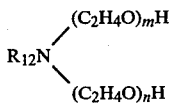

wherein $R_{12}$ is selected from alkyl and alkenyl groups of from about 14 to about 20 carbon atoms and m+n equals from about 2 to about 30.

8. The composition of any of claims 1 through 7 wherein the pH of the composition is from about 3 to about 5.

9. A fabric softening composition comprising:

I. water;

II. from about 3% to about 25% of a cationic fabric softener or mixture of fabric softeners selected from the group consisting of:

A. Mono nitrogen quaternary ammonium cationic salts having the structure:

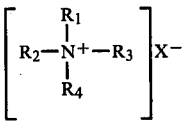

wherein $R_1$ is selected from the group consisting of $C_1$ to $C_{20}$ alkyl and alkenyl groups, $R_2$ is selected from the group consisting of $C_{14}$ to $C_{20}$ alkyl and alkenyl groups, and $R_3$ and $R_4$ are the same or different from each other and are selected from the group consisting of $C_1$ to $C_3$ alkyls, and $-(C_nH_{2n}O)_xH$ wherein n is 2 or 3, x is from 1 to about 3, and wherein $X^-$ is halide, $HSO_4^-$, nitrate, methylsulfate and ethylsulfate, B. Imidazolinium salts of the formula:

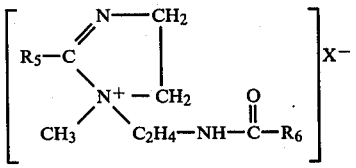

wherein $R_5$ and $R_6$ are the same or different from each other and are selected from the group consisting of $C_{14}$ to $C_{20}$ alkyl and alkenyl groups, and wherein $X^-$ is selected from the group consisting of halide, $HSO_4^-$, nitrate, methylsulfate or ethylsulfate, C. Di(2-amidoethyl)methyl quaternary ammonium salts having the structure:

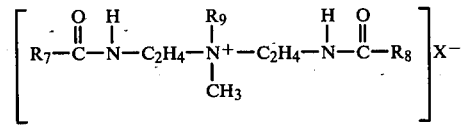

wherein $R_7$ and $R_8$ are the same or different from each other and are selected from the group consisting of $C_{14}$ to $C_{20}$ alkyl and alkenyl groups, wherein $R_9$ is selected from H, methyl, ethyl and $-(C_nH_{2n}O)_xH$ wherein n is 2 or 3 and x is from 1 to about 5, and wherein $X^-$ is selected from the group consisting of halide, $HSO_4^-$, nitrate, methylsulfate and ethylsulfate, and III. from about 0.5% to about 2% of an amine having the formula:

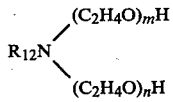

wherein $R_{12}$ is tallow, and the sum of m+n is about 20 and wherein the said amine is the most basic amine present in the composition; and IV. from about 1 to about 10 parts per million 5-chloro-2-methyl-3-isothiazolone;

wherein said composition has a pH of less than about 6.

10. The composition of claim 9 wherein II.A. is dihydrogenatedtallowdimethylammonium chloride, II.B. is 1-methyl-1-tallowamidoethyl-2-tallowimidazolinium methylsulfate having an Iodine Value of about 42 and II.C. is di(di-hydrogenatedtallowamidoethyl ethoxylated (2-ethoxy groups) methyl ammonium methylsulfate and wherein the said combination of II.A., II.B., and II.C. has an Iodine Value of about 10.5, and wherein the said composition has a pH of from about 3 to about 5.

* * * * *